US005158743A

United States Patent [19]

Fritzemeier et al.

[11] Patent Number: 5,158,743

[45] Date of Patent: Oct. 27, 1992

[54] HYDROGEN RESISTANT ALLOY

[75] Inventors: Leslie G. Fritzemeier; Thomas R. Palamides; John G. Somerville, all of West Hills, Calif.

[73] Assignee: Rockwell International Corporation, Seal Beach, Calif.

[21] Appl. No.: 690,874

[22] Filed: Apr. 24, 1991

[51] Int. Cl.[5] ..... C22C 38/50

[52] U.S. Cl. ..... 420/53; 148/327

[58] Field of Search ..... 420/53; 148/327

[56] References Cited

U.S. PATENT DOCUMENTS 3,065,068 11/1962 Dyrkaez et al. ..... 420/53

3,199,978 8/1965 Brown et al. ..... 420/53

FOREIGN PATENT DOCUMENTS 57-94562 6/1982 Japan ..... 420/53

60-29453 2/1985 Japan ..... 420/53

61-99659 5/1986 Japan ..... 420/53

*Primary Examiner*—Deborah Yee

*Attorney, Agent, or Firm*—H. Fredrick Hamann; Harry B. Field; David C. Faulkner

[57] ABSTRACT

A precipitation hardening, high strength alloy, having a composition comprising in weight percent, 25.0% nickel, 15.0% chromium, 1.25% molybdenum, 0.25% vanadium, 2.65% titanium, 0.25% aluminum, 0.005% carbon, and the balance iron with incidental impurities.

4 Claims, No Drawings

HYDROGEN RESISTANT ALLOY

BACKGROUND OF THE INVENTION

1. Field of the Invention

The present invention relates to an austenitic iron-base alloy and thermal-mechanical process which provides a hydrogen environment embrittlement resistant alloy having enhanced mechanical properties for elevated temperature service in hydrogen fueled rocket engine environments.

2. Description of Related Art

It is well known that alloys of iron and nickel can be produced to provide alloys having high strength at elevated temperatures under severe environment conditions. These alloys have, however, been shown to be susceptible in many cases to hydrogen environment embrittlement. Several iron-nickel-base superalloys have similarly been shown to be resistant to hydrogen environment embrittlement but do not possess the mechanical properties required for rocket propulsion application and especially for rocket engine turbine disk usage. The following references disclose alloys of this type.

U.S. Pat. No. 3,199,978 discloses a high-strength precipitation hardening austenitic alloy of iron, nickel and chromium containing at least one precipitation hardening component from the group consisting of titanium, and/or aluminum, incorporating critical amounts of boron therein.

U.S. Pat. No. 3,065,068 describes alloys encompassing a precipitation hardenable iron-base austenitic alloy containing up to 0.02% carbon, from 1.0% to 3.0% manganese, up to 1.5% silicon, from about 10% to about 22% chromium, from about 15% nickel, from about 0.25% to about 2% molybdenum, from about 0.5% to about 4.5% titanium, up to about 1.0% aluminum, from about 0.1% to about 1.5% vanadium, from about 0.1% to about 0.8% boron and the balance iron with incidental impurities.

However, none of the alloys disclosed in the aforementioned U.S. patents are formulated such that they exhibit acceptable high hydrogen environment embrittlement resistance for use as rocket engine turbine disks.

Accordingly, it is an object of the present invention to provide a heat resistant alloy exhibiting high hydrogen environment embrittlement resistant.

Another object of the present invention resides in a precipitation hardening, high-strength alloy, and a method of producing same.

It is a further object of the present invention to provide a precipitation hardened article of manufacture in the form of forgings and the like and specifically in the form of turbine disks.

These and other objects of the present invention will become apparent from a reading of the detailed description of the invention and attendant claims.

SUMMARY OF THE INVENTION

In accordance with the present invention, there is provided an austenitic iron-base alloy having a composition comprising in weight percent, 25.0% nickel, 15.0% chromium, 1.25% molybdenum, 0.25% vanadium, 2.65% titanium, 0.25% aluminum, 0.005% carbon, and the balance iron with incidental impurities.

DETAILED DESCRIPTION OF THE PREFERRED EMBODIMENT

The invention relates to an alloy having enhanced hydrogen environment embrittlement resistance from cryogenic up to 1300° F. An article of manufacture for use in such an environment such as a turbine disk would be formed from an austenitic iron-base alloy having a composition comprising in weight percent, 25.0% nickel, 15.0% chromium, 1.25% molybdenum, 0.25% vanadium, 2.65% titanium, 0.25% aluminum, 0.005% carbon, and the balance iron with incidental impurities.

The alloy is typically produced by vacuum induction melting a master heat from virgin materials. The vacuum induction melted ingot or billet produced from the alloy is vacuum arc re-melted and reduced to final product through standard hot working practices. The vacuum arc remelted ingot is homogenized for about 24 hours at 2125° F. followed by rotary forging to attain a 30% reduction, reheating to 2025° F., and rotary forging to attain a 50% reduction with cooling to ambient.

Turbine disk forgings would typically be produced from the billet in one or more forging operations. Forging is carried out in hot dies, preheated to approximately 1400° F. The billet is preheated to the desired forging temperature (cf. Table II) and reheated between forging steps as needed. Within the temperature ranges required for adequate microstructural control, forging can be accomplished in one step.

The preferred composition for the iron-base alloy of the present invention is shown in Table I:

TABLE I

| HEE Resistant Disk Alloy Chemistry (Weight Percent) | | | | | | | |
|---|---|---|---|---|---|---|---|
| Ni | Fe | Cr | Mo | V | Ti | Al | C |
| 25 | Bal | 15 | 1.25 | .25 | 2.65 | .25 | .005 |

Average room temperature tensile properties in hydrogen and helium environments are give in Table II for plates of the iron-base alloy material forged at several temperatures. Yield strength decreased and ductility increased with elevated forging temperature, especially from 1750° F. to 1800° F.

TABLE II

| Plate | Forging Temp. | Yield (ksi) | | Ultimate (ksi) | | Elongation (%) | | R of A (%) | |
|---|---|---|---|---|---|---|---|---|---|
| No. | (°F.) | H2 | He | H2 | He | H2 | He | H2 | He |
| 52 | 1700 | 137 | 136 | 171 | 171 | 18.8 | 18.8 | 37 | 34.6 |
| 53 | 1750 | 134 | 136 | 170 | 173 | 21.2 | 18.2 | 40.2 | 40.6 |
| 54 | 1800 | 127 | 129 | 171 | 169 | 21.9 | 23.6 | 33 | 35.7 |
| 55 | 1850 | 126 | 125 | 167 | 170 | 25.0 | 21.6 | 47.7 | 45.9 |

The results of Table II show that the alloy achieved the desired resistance to hydrogen environment embrittlement and that the tensile properties are appropriate for hdyrogen fueled rocket engine environments.

What is claimed is:

1. An austenitic iron-base alloy having a composition comprising in weight percent, 25.0% nickel, 15.0% chromium, 1.25% molybdenum, 0.25% vanadium, 2.65% titanium, 0.25% aluminum, 0.005% carbon, and the balance iron with incidental impurities.

2. An article of manufacture for use in a hydrogen embrittlement environment from crogenic up to 1300° F., formed from an austenitic iron-base alloy having a composition comprising in weight percent, 25.0% nickel, 15.0% chromium, 1.25% molybdenum, 0.25% vanadium, 2.65% titanium, 0.25% aluminum, 0.005% carbon, and the balance iron with incidental impurities.

3. A precipitation hardened article of manufacture having improved resistance to hydrogen embrittlement from cryogenic up to 1300° F., produced by forging a billet of an alloy comprising in weight percent, 25.0% nickel, 15.0% chromium, 1.25% molybdenum, 0.25% vanadium, 2.65% titanium, 0.25% aluminum, 0.005% carbon, and the balance iron with incidental impurities.

4. Turbine disk for use in a hydrogen embrittlement environment from cryogenic up to 1300° F., produced by forging a billet of an alloy comprising in weight percent, 25.0% nickel, 15.0% chromium, 1.25% molybdenum, 0.25% vanadium, 2.65% titanium, 0.25% aluminum, 0.005% carbon, and the balance iron with incidential impurities.

* * * * *